United States Patent [19]

Eck

[11] 4,361,824

[45] Nov. 30, 1982

[54] SLIDEWIRE WIPER CONTACT

[75] Inventor: Bertil Eck, Warrington, Pa.

[73] Assignee: Honeywell Inc., Minneapolis, Minn.

[21] Appl. No.: 291,871

[22] Filed: Aug. 10, 1981

[51] Int. Cl.[3] ..... H01C 10/32

[52] U.S. Cl. ..... 338/171; 338/202; 338/162

[58] Field of Search ..... 338/202, 171, 167, 176, 338/162, 174, 168; 200/276

[56] References Cited

U.S. PATENT DOCUMENTS

| | | | |
|---|---|---|---|
| 3,076,162 | 1/1963 | Ferrari | 338/167 |
| 4,020,444 | 4/1977 | Oelsch et al. | 338/167 X |

FOREIGN PATENT DOCUMENTS

| | | | |
|---|---|---|---|
| 134748 | 10/1902 | Fed. Rep. of Germany | 338/202 |
| 47-49134 | 12/1972 | Japan | 338/202 |
| 1006633 | 10/1965 | United Kingdom | 338/202 |

OTHER PUBLICATIONS

Bresg, IBM Technical Disclosure Bulletin, "Spring Contactor", vol. 10, No. 4, p. 363, Sep. 1967.

*Primary Examiner*—C. L. Albritton

*Attorney, Agent, or Firm*—Lockwood D. Burton; Mitchell J. Halista

[57] ABSTRACT

A slidewire wiper contact has a wiper arm mounted at one end on a rotatable shaft while the other end of the arm carries an electrically conductive support extending past the end of the arm. A free end of the electrically conductive support has attached thereto a plurality of substantially constant outer diameter coils of electrically conductive wire. The coils are arranged in a continuous spiral while the electrically conductive support is attached thereto by a low resistance connection extending along a line on an outer surface of the coils. Electrical connection means are attached to the electrically conductive support for movement therewith during rotation of the wiper arm to maintain an electrical connection to the conductive support.

7 Claims, 6 Drawing Figures

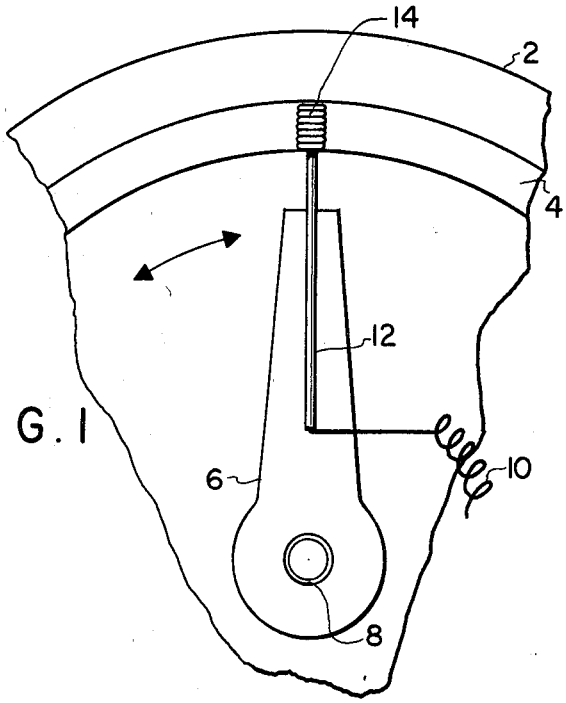
FIG. 1
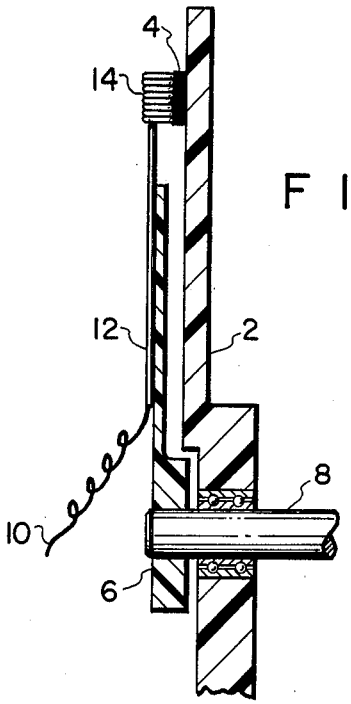
FIG. 2
FIG. 3
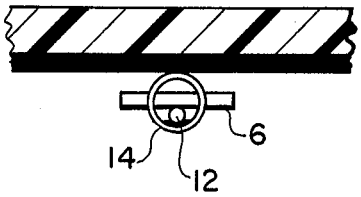
FIG. 5
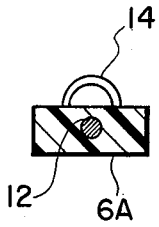
FIG. 4
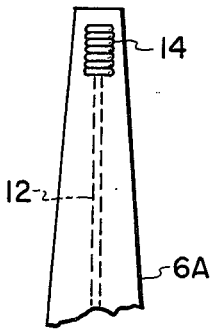
FIG. 6
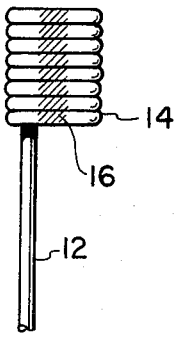

SLIDEWIRE WIPER CONTACT

BACKGROUND OF THE INVENTION

Field of the Invention

The present invention is directed to potentiometers. More specifically, the present invention is directed to an improved movable electrical wiper contact for contacting a resistance element in a potentiometer.

SUMMARY OF THE INVENTION

An object of the present invention is to provide an improved electrical movable wiper contact.

In accomplishing this and other objects, there has been provided, in accordance with the present invention a slidewire wiper contact having a plurality of substantially constant outer diameter coils of a spirally wound electrically conductive wire. The electrically conductive wire is mounted along a line on an outer surface of the coils by an electrical conductor which, in turn, is attached to a movable arm mounted for rotational movement to drive the coils across a resistance element.

BRIEF DESCRIPTION OF THE DRAWINGS

A better understanding of the present invention may be had when the following detailed description is read in connection with the accompanying drawings, in which:

FIG. 1 is a pictorial illustration of a portion of a potentiometer using an example of a slidewire wiper contact embodying the present invention, FIG. 2 is a side view of the wiper contact shown in FIG. 1, FIG. 3 is an end view of the wiper contact shown in FIG. 1, FIG. 4 is an alternate embodiment of a wiper contact embodying the present invention, FIG. 5 is an end view of the wiper contact shown in FIG. 4 and FIG. 6 is a modified form of the wiper contact shown in either FIGS. 1 and 4.

DESCRIPTION OF THE PREFERRED EMBODIMENT

Referring to FIGS. 1, 2 and 3 in more detail, there is shown a potentiometer or slidewire apparatus having an electrically non-conductive support plate 2 for supporting a resistance element 4 thereon. The resistance element 4 may advantageously have a semi-circular configuration to accommodate an arcuate movement of a wiper contact, as described hereinafter. The resistive element 4 may be any suitable resistance element conventionally used in potentiometers and may include, a wire wound resistance element, a deposit of an electrically resistive medium, a ribbon of resistive material, etc. A potentiometer arm 6 is rotatably pivoted at one end thereof on a support shaft 8. A flexible electrical connector 10 is attached to a rigid electrically conductive support rod 12 mounted, e.g., adhesively bonded, on the support arm 6. Alternatively, the arm 6 can be made of an electrically conductive material, e.g., copper, and the support rod 12 would also be made of copper and soldered to the arm 6. In such an arrangement, the arm 6 would be electrically insulated from the drive shaft 8 by any suitable means. A wiper contact 14 is attached to an outer end of the electrical support rod 12. The wiper contact 14 includes a plurality of substantially constant outer diameter spirally wound coils of an uninsulated electrical conductor such as a copper wire which is wound on a uniform diameter mandrel. The inner diameter surface of the coils of the electrical wire forming the electrical contact 14 are coaxially attached to the support rod 12 by any suitable means, e.g., soldering. The side and end views in FIGS. 2 and 3, respectively, show additional structural details of the wiper structure shown in FIG. 1.

In FIGS. 4 and 5, there is shown a modified form of the wiper contact structure shown in FIGS. 1, 2 and 3. In this modified form of the wiper contact of the present invention, the coils 14 are partially embedded in a molded support arm 6A, e.g., the arm 6A could be made of a thermosetting plastic material, along with the support rod 12. In FIG. 6, there is shown a further modification of the wiper contact wherein a low resistance electrically conductive material, e.g., silver, is plated along a transverse line on an outer surface of the coils of the wiper contact 14 to improve the electrical contact, i.e., reduce the resistance of the electrical connection produced by the wiper contact 14 on the resistance element 4. The wiper contact of the present invention provides the advantage of a multi-contact design which results in lower contact resistance and improves the stability of the contact by providing a degree of adaptation to mechanical eccentricities of the surface of the resistance element 4 while spreading the wear of the wiper contact over the surface of the plurality of coils forming the wiper contact. Conventional wiper contacts using either a stamped metal contact or a group of individual wires secured together in a molded structure show a tendency to spread apart when pushed across the resistive element. The present invention overcomes this problem and offers the additional advantages of elimination of sharp edges, lower manufacturing cost, increased contact density and adaptability to miniaturization which lends itself to plural wiper contact use in a single potentiometer structure.

Accordingly, it may be seen, that there has been provided, in accordance with the present invention an improved wiper contact for a slidewire potentiometer.

The embodiments of the invention in which an exclusive property or privilege is claimed are defined as follows:

1. A slidewire wiper contact comprising a plurality of substantially constant outer diameter coils of a spirally wound electrically conductive wire, a coil support connected to said coils to coaxially support said plurality of coils, a support arm attached to said coil support for supporting said coil support and said support arm being made of a plastic material and said coils are each partially embedded in said material, means for driving said support arm to urge said plurality of coils across a resistance element contacted by an outside surface of said coils.

2. A wiper contact as set forth in claim 1 wherein said coil support is an electrically conductive rod attached on a transverse line across an inner diameter of said coils and said rod is embedded in said plastic material.

3. A wiper contact as set forth in claim 2 wherein said coils and said rod are made of copper.

4. A wiper contact as set forth in claim 1 and further including a flexible electrically conductive means for providing an electrical connection to said coils.

5. A wiper contact as set forth in claim 2 and further including a flexible electrically conductive means for providing an electrical connection to said coils.

6. A wiper contact as set forth in claim 1 wherein said means for driving said support arm includes a rotatable shaft connected to one end of said support arm to induce an arcuate movement of said coils.

7. A wiper contact as set forth in claim 2 wherein said means for driving said support arm includes a rotatable shaft connected to one end of said support arm to induce an arcuate movement of said coils.

* * * * *